US010066650B2

(12) United States Patent
Tanaka

(10) Patent No.: US 10,066,650 B2
(45) Date of Patent: Sep. 4, 2018

(54) CYLINDER DRIVING APPARATUS

(71) Applicant: KAYABA INDUSTRY CO., LTD., Tokyo (JP)

(72) Inventor: Daisuke Tanaka, Gifu (JP)

(73) Assignee: KYB Corporation, Tokyo (JP)

( * ) Notice: Subject to any disclaimer, the term of this patent is extended or adjusted under 35 U.S.C. 154(b) by 448 days.

(21) Appl. No.: 14/432,756

(22) PCT Filed: Sep. 3, 2013

(86) PCT No.: PCT/JP2013/073592
§ 371 (c)(1),
(2) Date: Apr. 1, 2015

(87) PCT Pub. No.: WO2014/057746
PCT Pub. Date: Apr. 17, 2014

(65) Prior Publication Data

US 2015/0260204 A1 Sep. 17, 2015

(30) Foreign Application Priority Data

Oct. 10, 2012 (JP) ..... 2012-225279

(51) Int. Cl.
*F15B 15/14* (2006.01)
*F15B 7/00* (2006.01)
*F15B 15/18* (2006.01)

(52) U.S. Cl.
CPC ..... *F15B 15/149* (2013.01); *F15B 7/006* (2013.01); *F15B 15/1423* (2013.01); *F15B 15/18* (2013.01);
(Continued)

(58) Field of Classification Search
CPC ..... F15B 15/149; F15B 15/18; F15B 7/006; F15B 15/1423
(Continued)

(56) References Cited

U.S. PATENT DOCUMENTS 5,975,967 A * 11/1999 Nishi ..... B63H 20/10 29/523
7,069,675 B2 * 7/2006 Nishi ..... E02F 9/2267 37/236
(Continued)

FOREIGN PATENT DOCUMENTS

JP 49-115594 U 10/1974
JP 08-042512 A 2/1996
(Continued)

OTHER PUBLICATIONS

Machine translation of JP 2002-048105 (Teraoka et al. Translated to english by Google Translate. retrieved on Jun. 12, 2017 from <URL:https://patentscope.wipo.int/search/en/detail.jsf?docId=JP67128014&redirectedID=true>).*

*Primary Examiner* — Michael Leslie
*Assistant Examiner* — Richard Drake
(74) *Attorney, Agent, or Firm* — Rabin & Berdo, P.C.

(57) ABSTRACT

A cylinder driving apparatus includes a first passage connecting a first chamber of a cylinder to a first port of a pump; a second passage connecting a second chamber of the cylinder to a tank; a third passage connecting a second port of the pump to the tank; a throttle configured to apply resistance to a working fluid flowing through the third passage; and an operated check valve provided in the first passage to allow the working fluid to flow from the pump into the first chamber. The operated check valve is configured to allow the working fluid to flow from the first chamber into the pump in accordance with a fluid pressure of the working fluid in the third passage between the pump and the throttle.

4 Claims, 3 Drawing Sheets

(52) U.S. Cl.
CPC ..... *F15B 2211/2053* (2013.01); *F15B 2211/20561* (2013.01); *F15B 2211/27* (2013.01); *F15B 2211/3051* (2013.01); *F15B 2211/3058* (2013.01); *F15B 2211/40507* (2013.01); *F15B 2211/40584* (2013.01); *F15B 2211/41563* (2013.01); *F15B 2211/50518* (2013.01); *F15B 2211/5159* (2013.01); *F15B 2211/7053* (2013.01); *F15B 2211/761* (2013.01); *F15B 2211/785* (2013.01)

(58) Field of Classification Search
USPC ..... 60/459
See application file for complete search history.

(56) References Cited

U.S. PATENT DOCUMENTS 7,343,740 B2 * 3/2008 Sakai ..... F15B 21/041 60/453
7,788,914 B2 * 9/2010 Rho ..... F15B 11/08 60/402
8,186,082 B2 * 5/2012 Sato ..... E01H 5/06 37/234
8,800,279 B2 * 8/2014 Kita ..... F16H 61/4139 60/488
8,973,869 B2 * 3/2015 Onomichi ..... B64C 25/22 244/102 A
2006/0026955 A1 * 2/2006 Bogelein ..... B62D 5/065 60/464
2007/0131883 A1 * 6/2007 Goodrich ..... A61G 3/061 251/12
2007/0209502 A1 9/2007 Pasquali
2010/0048340 A1 * 2/2010 Nakamura ..... F16D 48/02 475/129
2011/0248196 A1 10/2011 Anderson
2012/0285152 A1 * 11/2012 Sugano ..... B66D 1/44 60/325

FOREIGN PATENT DOCUMENTS

JP 52-064294 U 5/1997
JP 2824659 B2 11/1998
JP 2002-048105 A 2/2002

* cited by examiner

CYLINDER DRIVING APPARATUS

TECHNICAL FIELD

The present invention relates to a cylinder driving apparatus for driving a cylinder.

BACKGROUND ART

JP2824659B discloses a cylinder driving apparatus for driving a single acting cylinder using working oil. The cylinder driving apparatus is configured to cause a cylinder to expand and contract by supplying the working oil into a bottom side chamber of the cylinder and discharging the working oil from the bottom side chamber.

SUMMARY OF INVENTION

However, the cylinder driving apparatus described above includes a switch valve having a spool that moves in accordance with a pilot pressure, thereby enabling working oil stored in a tank to be supplied to a pump and enabling the working oil in the bottom side chamber to be discharged into the tank. Therefore the configuration of the cylinder driving apparatus is complicated.

An object of the present invention is to provide a cylinder driving apparatus having a small number of components and a simple configuration.

A cylinder driving apparatus according to an aspect of the present invention includes: a cylinder having a first chamber and a second chamber that are partitioned by a piston provided on a piston rod; a pump including a first port and a second port, the pump being configured to be capable of discharging a working fluid from either port; a tank configured to store the working fluid. The cylinder driving apparatus also includes: a first passage connecting the first chamber to the first port; a second passage connecting the second chamber to the tank; a third passage connecting the second port to the tank; a throttle configured to apply resistance to the working fluid flowing through the third passage; and an operated check valve provided in the first passage. The operated check valve is configured to allow the working fluid to flow from the pump into the first chamber. The operated check valve is also configured to allow the working fluid to flow from the first chamber into the pump in accordance with a fluid pressure of the working fluid in the third passage between the pump and the throttle. The cylinder is configured such that when the pump discharges the working fluid from the first port, the discharged working fluid is supplied to the first chamber via the operated check valve, thereby causing the piston rod to move in an expansion direction. Further, the cylinder is configured such that when the pump discharges the working fluid from the second port, the working fluid in the first chamber is discharged from the first chamber via the operated check valve, thereby causing the piston rod to move in a contraction direction.

DESCRIPTION OF EMBODIMENTS

Embodiments of the present invention will be described below with reference to the attached figures.

First Embodiment

Figure 1:
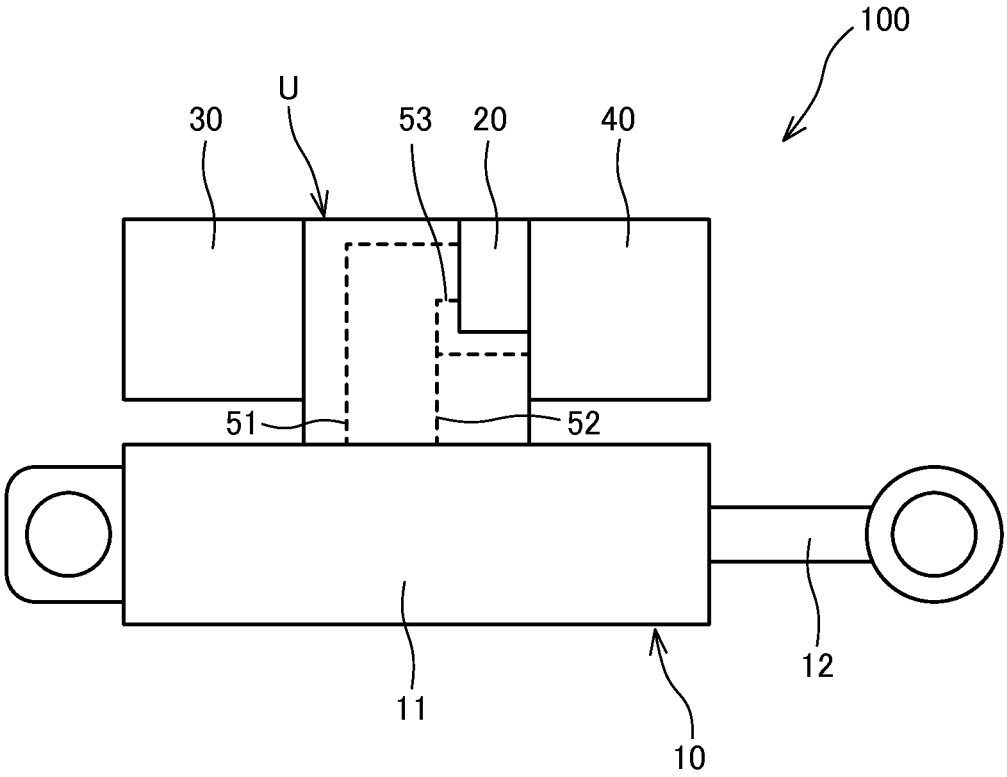
FIG. 1 is a schematic view showing a configuration of a cylinder driving apparatus according to a first embodiment.
Figure 2:
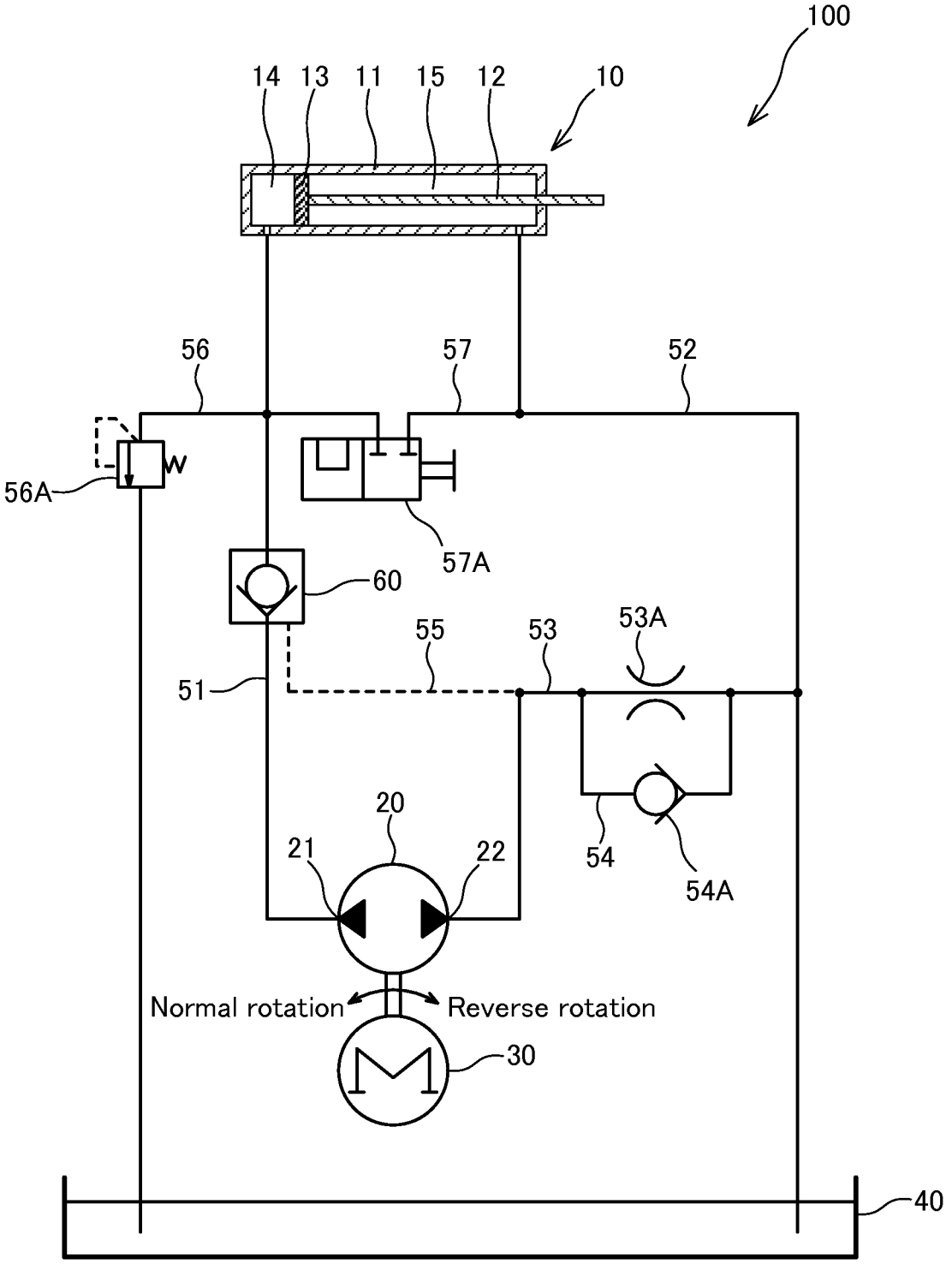
FIG. 2 is a circuit diagram showing the cylinder driving apparatus according to the first embodiment.

Referring to FIGS. 1 and 2, a configuration of a cylinder driving apparatus 100 according to a first embodiment will be described.

The cylinder driving apparatus 100 shown in FIGS. 1 and 2 is installed in an agricultural machine, an operating machine, or the like in order to drive a cylinder 10 using working oil.

The cylinder driving apparatus 100 includes the cylinder 10 configured to be capable of expanding and contracting, a pump 20 configured to pump the working oil as a working fluid, a drive motor 30 configured to drive the pump 20, and a tank 40 configured to store the working oil.

The pump 20, the drive motor 30, the tank 40, various passages 51, 52, 53 through which the working oil flows, valves provided in the passages 51, 52, 53, and so on together constitute a single unit member U (see FIG. 1). The unit member U is disposed adjacent to the cylinder 10. As a result, the cylinder driving apparatus 100 can be configured to be compact.

As shown in FIG. 2, the cylinder 10 includes a cylindrical main body portion 11, a piston rod 12 inserted into the main body portion 11 from one end side of the main body portion 11, and a piston 13 provided on an end portion of the piston rod 12 in order to slide along an inner peripheral surface of the main body portion 11. An interior of the main body portion 11 is partitioned by the piston 13 into a first chamber 14 and a second chamber 15. The working oil is charged into the first chamber 14 and the second chamber 15.

An end portion of the main body portion 11 of the cylinder 10 is fixed to a body of the agricultural machine or the like in a predetermined position, while an end portion of the piston rod 12 positioned on an outer side of the main body portion 11 is fixed to a driving subject.

The cylinder 10 is a single acting cylinder. The cylinder 10 is configured such that when the working oil is supplied to the first chamber 14, the piston rod 12 is moved in an expansion direction by an oil pressure of the working oil in the first chamber 14. The cylinder 10 is configured such that when the working oil is discharged from the first chamber 14, the piston rod 12 is moved in a contraction direction by a piston rod 12 side own weight (the weight of the piston rod 12 and the driving subject themselves).

The pump 20 is a bidirectional pump including a first port 21 and a second port 22. The pump 20 is coupled to the drive motor 30 so as to be driven on the basis of a rotary driving force of the drive motor 30. When the drive motor 30 rotates normally, the pump 20 discharges working oil suctioned through the second port 22 from the first port 21, and when the drive motor 30 rotates in reverse, the pump 20 discharges working oil suctioned through the first port 21 from the second port 22.

Hence, a discharge direction of the working oil discharged from the pump 20 is switched in accordance with a rotation direction of the drive motor 30.

The first chamber 14 of the cylinder 10 and the first port 21 of the pump 20 communicate with each other via a first passage 51. The second port 22 of the pump 20 and the tank 40 communicate with each other via a third passage 53. Further, the second chamber 15 of the cylinder 10 communicates with the third passage 53 via a second passage 52.

Hence, the second chamber 15 is connected to the tank 40 through the second passage 52 and the third passage 53.

An orifice 53A is provided in the third passage 53. The orifice 53A functions as a throttle that applies resistance to the working oil flowing through the third passage 53. Further, a bypass passage 54 that bypasses the orifice 53A is connected the third passage 53. One end of the bypass passage 54 is connected to the third passage 53 on the pump 20 side from a position in which the orifice 53A is disposed, and another end of the bypass passage 54 is connected to the third passage 53 on the tank 40 side from the position in which the orifice 53A is disposed.

A check valve 54A is provided in the bypass passage 54. The check valve 54A is configured to allow the working oil to flow only toward the pump 20.

An operated check valve 60 is disposed in the first passage 51 that connects the first chamber 14 of the cylinder 10 to the first port 21 of the pump 20.

The operated check valve 60 is configured to allow the working oil to flow from the pump 20 to the first chamber 14 when the pump 20 discharges the working oil from the first port 21. Further, the working oil in the third passage 53 between the pump 20 and the orifice 53A is led into a back pressure chamber of the operated check valve 60 at all times through a connecting passage 55. The operated check valve 60 is configured to open when an oil pressure (a pilot pressure) of the working oil led through the connecting passage 55 reaches a valve opening pressure, thereby allowing the working oil to flow from the first chamber 14 into the pump 20.

A return passage 56 for returning the working oil to the tank 40 is provided in the first passage 51 on the cylinder 10 side from a position in which the operated check valve 60 is disposed. One end of the return passage 56 is connected to the first passage 51, and another end of the return passage 56 is connected to the tank 40.

A relief valve 56A is disposed in the return passage 56. The relief valve 56A opens when the oil pressure of the working oil in the first passage 51 reaches a relief pressure, thereby allowing the working oil to flow through. The working oil that flows through the relief valve 56A is discharged into the tank 40 through the return passage 56.

The second passage 52, which is provided to connect the second chamber 15 of the cylinder 10 to the tank 40, is configured such that one end thereof is connected to the third passage 53 on the tank 40 side from the orifice 53A.

A communicating passage 57 is provided in the first passage 51 and the second passage 52 in order to connect these passages 51, 52. A manually operated manual valve 57A is provided in the communicating passage 57. The manual valve 57A is capable of opening and closing the communicating passage 57. Normally, the manual valve 57A is closed so that communication between the first passage 51 and the second passage 52 is blocked. When the manual valve 57A is operated so as to open, the first passage 51 and the second passage 52 communicate with each other. As a result, the first chamber 14 of the cylinder 10 is opened onto the tank 40, and thus the cylinder 10 can be operated manually.

Next, referring to FIG. 2, an operation of the cylinder driving apparatus 100 will be described.

During an expansion operation of the cylinder 10, the drive motor 30 is driven to rotate normally.

When the drive motor 30 rotates normally, the working oil in the second chamber 15 of the cylinder 10 and the tank 40 passes through the check valve 54A and the orifice 53A so as to be suctioned into the pump 20 through the second port 22, and is then discharged from the first port 21 of the pump 20. The working oil discharged from the pump 20 pushes open the operated check valve 60, and is thus supplied to the first chamber 14 of the cylinder 10. Accordingly, the oil pressure of the working oil in the first chamber 14 increases so that the piston rod 12 is moved in the expansion direction by the oil pressure, and as a result, the cylinder 10 expands.

When an external force acts on the piston rod 12 during expansion of the cylinder 10 or the like such that the oil pressure in the first chamber 14 reaches the relief pressure of the relief valve 56A, the relief valve 56A opens, and as a result, the working oil is discharged into the tank 40 through the first passage 51 and the return passage 56. By opening the relief valve 56A in this manner, the oil pressure in the first chamber 14 and the first passage 51 can be prevented from increasing excessively.

During a contraction operation of the cylinder 10, on the other hand, the drive motor 30 is driven to rotate in reverse.

When the drive motor 30 rotates in reverse, the pump 20 discharges the working oil suctioned through the first port 21 from the second port 22. The working oil discharged from the second port 22 passes through the orifice 53A in the third passage 53, and therefore the oil pressure of the working oil on an upstream side of the orifice 53A increases. When the oil pressure on the upstream side of the orifice 53A reaches the valve opening pressure, the operated check valve 60 opens such that the working oil is discharged from the first chamber 14 of the cylinder 10 toward the pump 20. At this time, the piston rod 12 is moved in the contraction direction by the weight of the piston rod 12 and the driving subject themselves, and the working oil is discharged from the first chamber 14. As a result, the cylinder 10 contracts.

The working oil discharged from the first chamber 14 is discharged from the second port 22 of the pump 20, and is then led into the second chamber 15 of the cylinder 10 and the tank 40 through the orifice 53A in the third passage 53.

With the cylinder driving apparatus 100 according to the first embodiment, described above, the single acting cylinder 10 can be caused to expand and contract without providing a spool type switch valve such as that of the related art. Therefore, a number of components provided in the cylinder driving apparatus 100 can be reduced, and as a result, the configuration of the cylinder driving apparatus 100 can be simplified.

In the cylinder driving apparatus 100, one end of the second passage 52 is connected to the third passage 53 on the tank 40 side from the orifice 53A. However, this end of the second passage 52 may be connected to the tank 40 directly. The cylinder 10 can be caused to expand and contract by the cylinder driving apparatus 100 likewise in a case where the second passage 15 of the cylinder 10 is connected to the tank 40 by the second passage 52, and as a result, the configuration of the cylinder driving apparatus 100 can be simplified.

Second Embodiment

Next, referring to FIG. 3, the cylinder driving apparatus 100 according to a second embodiment of the present invention will be described. The cylinder driving apparatus 100 according to the second embodiment differs from the cylinder driving apparatus according to the first embodiment in the configuration of the second passage 52.

Figure 3:
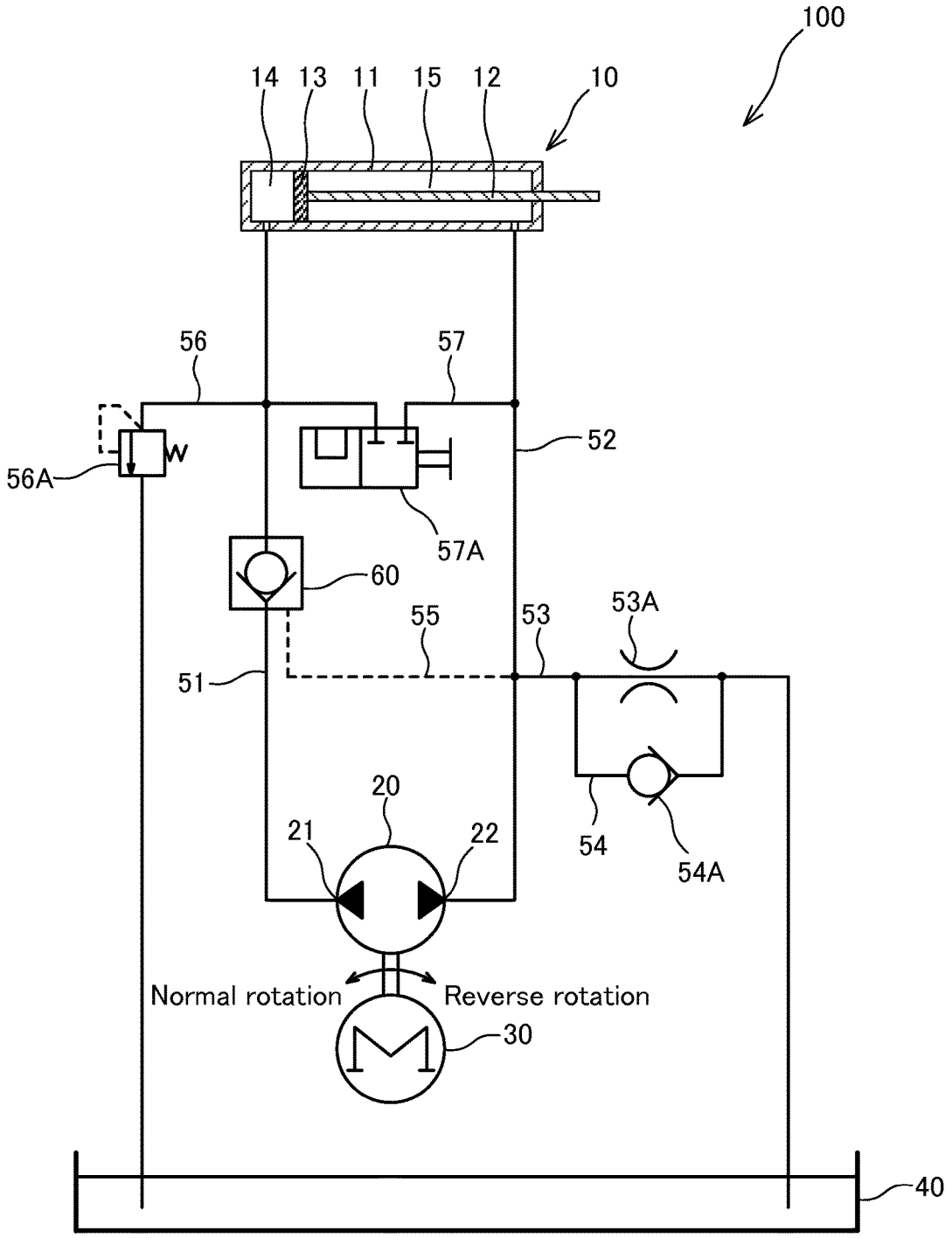
FIG. 3 is a circuit diagram showing a cylinder driving apparatus according to a second embodiment.

As shown in FIG. 3, in the cylinder driving apparatus 100 according to the second embodiment, one end of the second passage 52 is connected to the third passage 53 on the pump 20 side from the orifice 53A instead of being connected to the third passage 53 on the tank 40 side from the orifice 53A.

In the cylinder driving apparatus 100 thus configured, when the drive motor 30 rotates normally, the working oil in the second chamber 15 of the cylinder 10 is suctioned into the pump 20 through the second passage 52 and the third passage 53. At this time, the working oil in the tank 40 is likewise suctioned into the pump 20 through the bypass passage 54 having the check valve 54A and the third passage 53 having the orifice 53A. The working oil that is suctioned through the second port 22 of the pump 20 is discharged from the first port 21 of the pump 20. The discharged working oil pushes open the operated check valve 60 so as to be supplied to the first chamber 14 of the cylinder 10. Accordingly, the oil pressure of the working oil in the first chamber 14 increases such that the piston rod 12 is moved in the expansion direction by the oil pressure. As a result, the cylinder 10 expands.

When the drive motor 30 rotates in reverse, on the other hand, the pump 20 discharges the working oil suctioned through the first port 21 from the second port 22. The working oil discharged from the second port 22 passes through the orifice 53A in the third passage 53, and therefore the oil pressure of the working oil on the upstream side of the orifice 53A increases. When the oil pressure on the upstream side of the orifice 53A reaches the valve opening pressure, the operated check valve 60 opens such that the working oil is discharged from the first chamber 14 of the cylinder 10 toward the pump 20.

The comparatively high pressure working oil on the upstream side of the orifice 53A is also supplied to the second chamber 15 of the cylinder 10 through the second passage 52, and serves as thrust for moving the piston rod 12 in the contraction direction. The piston rod 12 is therefore moved in the contraction direction by the thrust and the piston rod 12 side own weight. Accordingly, the working oil is discharged from the first chamber 14, and as a result, the cylinder 10 contracts.

With the cylinder driving apparatus 100 according to the second embodiment, described above, the working oil on the upstream side of the orifice 53A is led to the second chamber 15 when the cylinder 10 contracts, and the oil pressure of the working oil acts as thrust for moving the piston rod 12. When the thrust and the piston rod 12 side own weight are used together in this manner, the cylinder 10 can be caused to contract smoothly.

Moreover, likewise with the cylinder driving apparatus 100 according to the second embodiment, the number of components provided in the cylinder driving apparatus 100 can be reduced, and as a result, the configuration of the cylinder driving apparatus 100 can be simplified.

Embodiments of the present invention were described above, but the above embodiments are merely examples of applications of the present invention, and the technical scope of the present invention is not limited to the specific configurations of the above embodiments.

In the cylinder driving apparatuses 100 according to the first embodiment and the second embodiment, the bypass passage 54 having the check valve 54A is provided in the third passage 53, but the check valve 54A and the bypass passage 54 do not necessarily have to be provided. When the check valve 54A and the bypass passage 54 are omitted, the orifice 53A is set to apply a smaller degree of resistance than in the first embodiment and the second embodiment. Likewise in this case, the orifice 53A is configured such that when the pump 20 rotates in reverse, the oil pressure on the upstream side of the orifice 53A reaches the valve opening pressure.

In the cylinder driving apparatuses 100 according to the first embodiment and the second embodiment, the cylinder 10 is configured such that the piston rod 12 is moved in the contraction direction by the piston rod 12 side own weight. However, the cylinder 10 may be configured such that the piston rod 12 is moved in the contraction direction by a biasing force of a biasing member such as a spring.

Furthermore, in the cylinder driving apparatuses 100 according to the first embodiment and the second embodiment, working oil is used as the working fluid, but an incompressible fluid such as water or an aqueous solution may be used instead of working oil.

This application claims priority based on Japanese patent application No. 2012-225279, filed with the Japan Patent Office on Oct. 10, 2012, the entire contents of which are incorporated into this specification by reference.

The invention claimed is:

1. A cylinder driving apparatus for driving a cylinder, comprising:

a cylinder having a first chamber and a second chamber that are partitioned by a piston provided on a piston rod;

a pump including a first port and a second port, the pump being configured to be capable of discharging a working fluid from each of the first port and the second port, respectively;

a tank configured to store the working fluid;

a first passage connecting the first chamber to the first port;

a second passage connecting the second chamber to the tank;

a third passage connecting the second port to the tank;

a throttle located along the third passage to apply resistance to the working fluid flowing through the third passage;

an operated check valve provided in the first passage to allow the working fluid to flow from the pump into the first chamber, the operated check valve being configured to allow the working fluid to flow from the first chamber into the pump according to a fluid pressure of the working fluid in the third passage between the pump and the throttle;

a bypass passage connected to the third passage and having a first end connected to the third passage on one side of the throttle and having an opposite end connected to the third passage on an opposite side of the throttle from the one side, so as to bypass the throttle; and a check valve provided in the bypass passage to allow the working fluid flowing through the bypass passage to flow only in a flow direction toward the pump, wherein one end of the second passage is connected to the third passage at a junction, such that the throttle is connected between the junction and the pump, and the cylinder is configured such that when the pump discharges the working fluid from the first port, the discharged working fluid is supplied to the first chamber via the operated check valve, thereby causing the piston rod to move in an expansion direction, and when the pump discharges the working fluid from the second port, the throttle generates an increase in working fluid pressure to operate the operated check valve, and the working fluid in the first chamber is discharged from the first chamber via the operated check valve, thereby causing the piston rod to move in a contraction direction.

2. The cylinder driving apparatus as defined in claim 1, wherein the cylinder is configured such that the piston rod is moved in the expansion direction by a fluid pressure of the working fluid in the first chamber, and the piston rod is moved in the contraction direction by a piston rod side own weight.

3. The cylinder driving apparatus as defined in claim 1, wherein a connecting passage for operating the operated check valve in the first passage is connected to the third passage on an opposite side of the throttle from the junction of the second passage and the third passage.

4. The cylinder driving apparatus as defined in claim 1, wherein, when the pump discharges the working fluid from the first port:

the pump is configured to intake working fluid from both the second chamber and the tank, the working fluid from the tank is configured to combine with the working fluid from the second chamber at the junction, and the working fluid from the tank and the second chamber are configured to be received at the second port from the junction via both the throttle in the third passage and the check valve in the bypass passage.

* * * * *